US008534386B2

(12) United States Patent
Ge

(10) Patent No.: US 8,534,386 B2
(45) Date of Patent: Sep. 17, 2013

(54) ARTICULATED APPARATUS FOR HANDLING A DRILLING TOOL

(76) Inventor: Yaogen Ge, Katy, TX (US)

( * ) Notice: Subject to any disclaimer, the term of this patent is extended or adjusted under 35 U.S.C. 154(b) by 163 days.

(21) Appl. No.: 12/944,291

(22) Filed: Nov. 11, 2010

(65) Prior Publication Data

US 2011/0108264 A1 May 12, 2011

Related U.S. Application Data

(60) Provisional application No. 61/260,681, filed on Nov. 12, 2009.

(51) Int. Cl.
*E21B 19/16* (2006.01)

(52) U.S. Cl.
USPC ..... 175/85; 175/162; 166/77.51; 166/85.1; 414/917

(58) Field of Classification Search
USPC ..... 166/77.51, 85.1; 175/85, 162, 220; 414/680, 917; 901/15
See application file for complete search history.

(56) References Cited

U.S. PATENT DOCUMENTS 3,262,593 A * 7/1966 Hainer ..... 414/619
3,266,582 A * 8/1966 Homanick ..... 175/57
4,234,150 A 11/1980 Mee et al.
4,274,778 A 6/1981 Putnam et al.
4,725,179 A 2/1988 Woolslayer et al.
5,667,026 A 9/1997 Lorenz et al.
6,318,214 B1 11/2001 Buck
6,581,698 B1 * 6/2003 Dirks ..... 175/52
7,178,612 B2 2/2007 Belik
7,249,639 B2 7/2007 Belik
7,455,128 B2 11/2008 Belik
2005/0047884 A1 3/2005 Belik
2008/0257607 A1 * 10/2008 Winter ..... 175/162

* cited by examiner

*Primary Examiner* — William P Neuder
*Assistant Examiner* — Richard Alker
(74) *Attorney, Agent, or Firm* — Egbert Law Offices, PLLC

(57) ABSTRACT

An articulated apparatus for handling a drilling to has a base, a first set of arms pivotally connected at one end to the base and extending outwardly therefrom, a joint member pivotally connected to an opposite end of the first set of arms, a second set of arms pivotally connected at one end of to the joint member and extending outwardly therefrom, and a carrier assembly pivotally connected to an opposite end of the second set of arms. The carrier assembly is suitable for carrying the drilling tool so as to allow the drilling tool to move upwardly and downwardly. A drive system is cooperative with the first and second sets of arms so as to move the drilling tool between a stowed position and a deployed position.

23 Claims, 9 Drawing Sheets

ARTICULATED APPARATUS FOR HANDLING A DRILLING TOOL

RELATED U.S. APPLICATIONS

The present application claims priority from prior-filed U.S. Provisional Application No. 61/260,681, filed on Nov. 12, 2009.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to an articulated apparatus for handling drilling equipment, tools and other apparatus. More particularly, the present invention relates to an articulated apparatus having articulated sets of arms which move the drilling tool between a stowed position and a deployed position. More specifically, the present invention relates to an articulated handling apparatus which allows for horizontally and vertically adjustable movement of the drilling tool.

2. Description of Related Art Including Information Disclosed Under 37 CFR 1.97 and 37 CFR 1.98

In the oil and gas industry, various tools are required to be installed in a location adjacent to the well bore. Generally, the drill string is made up of a drill pipe and a bottom hole assembly. During the installation of such a drill string, various components must be threaded together in a quick and efficient manner. In other circumstances, tools must be supplied in a location over well center or over the mouse hole. In most operations, it is imperative that the various components of the drilling operation be supplied in a quick, efficient and safe manner.

The handling of a drilling string can be a routine and tedious job performed on almost a daily basis. The apparatus that is normally called a power tong or a roughneck is often utilized to make up or break the threaded tool joint connection of a drilling string. In normal operation, it is necessary to move the power tong or the roughneck between various locations including the well center, the mouse hole and a storage position. It is often difficult to move such apparatus on the drilling rig due to the heavy weight of such a device. Additionally, there is very limited space around the well center and, as such, efficient handling is required in limited space availability. Additionally, and furthermore, the need to move such heavy equipment in such a limited area can often cause accidents that could damage drilling apparatus and injure the rig crew. In the past, one method that is used carry the power tong or roughneck from the well enter backward and forward is mounting the unit on a trolley that rides on a pair of tracks mounted on the drill floor. The problem with this configuration is that the floor-mounted tracks often create tripping hazards for the rig crew. It becomes difficult and unusually complex when multiple locations are required to move the units. Such floor-mounted tracks often occupy too much space on the rig.

Another type of device that is used is a telescopic arm driven by a hydraulic cylinder. This type of carrying device requires extra space and is costly to manufacture. These types of carrying devices are also limited with respect to weight-carrying requirements and size.

Another type of device is used to accomplish the movement of various drilling apparatus is to swing the tong or roughneck by using a C-shaped mechanism where the unit is pivotally hanging on the top the structure. A problem with this type of device is that is difficult to position the unit because the weight of unit keeps the vertical position. Additionally, it is limited as having a relative short reach-out capability.

In the past, various U.S. patents have issued relating to such handling apparatus. For example, U.S. Pat. No. 4,234,150, issued on Nov. 18, 1980 to Mee et al., describes a mechanical arm assembly in which the distal end is movable in a straight line relative to the proximal end thereof. The articulated arm includes a first arm which incorporates a first parallelogram linkage and a second arm which includes a second parallelogram linkage. These adjacent ends of the parallelogram linkages are drivingly connected to one another whereby rotation of the first arm about the first end support alters the geometry of the first parallelogram linkage which, in turn, effects a corresponding alteration in the geometry of the second parallelogram linkage. This causes the movement of the distal end of the second arm in a straight line relative to the proximal end of the first arm.

U.S. Pat. No. 4,274,778, issued on Jun. 23, 1981 to Putnam et al., shows a mechanized stand handling apparatus for drilling rigs. This apparatus is suitable for the handling of drill collars and pipe stands. This apparatus is comprised of hydraulically-mechanized derrickman and associated finger-board lock bars adapted for the remote control in the placement of the stands in a derrick. This allows the device to be in alignment with the rotary table and fully placed within the racking fingers. The stand handling mechanism has articulated arms extensible by an actuator apparatus housed entirely within the confines thereof.

U.S. Pat. No. 5,667,026, issued on Sep. 16, 1997 to Lorenz et al., describes a positioning apparatus for a power tong. This positioning apparatus moves a power tong between an operative position and an inoperative position. The positioning apparatus has a first arm and a second arm. One end of the first arm is pivotally connected to one end of the second arm while the other end of both the first arm and the second arm are pivotally mounted on a beam attached to the drilling tower. Both arms can be extended and retracted in unison to move the power tong towards and away from its operative position circumjacent a pipe string.

U.S. Pat. No. 6,318,214, issued on Nov. 20, 2001 to A. Buck, teaches a power tong positioning apparatus that is positionable on the surface of drilling rig deck and attachable to at least one power tong. The power tong support is adapted to position at least one power tong so that it may engage a tubular member. The power tong positioning apparatus includes a frame, a base movably positioned on the frame, and a power tong support attached to the base and movably attachable to at least one power tong.

U.S. Pat. No. 7,178,612 issued on Feb. 20, 2007, U.S. Pat. No. 7,249,639 issued on Jul. 31, 2007, and U.S. Pat. No. 7,455,128 issued on Nov. 25, 2008, each teach an automated arm for positioning of drilling tools, such as an iron roughneck. The apparatus described in these patents serves to move an iron roughneck into position to allow making-up or breaking-out of threaded joints of a drill string. The apparatus may also be used to move other drilling equipment into position on the centerline of the well or at mouse holes. A self-balanced, dual-synchronized parallelogram arm is utilized to accomplish the movement of the devices. Hydraulic or pneumatic cylinders are used for extension and retraction of the arm rather than to support the tool. The arm may hold the tool in any position without cylinder assistance. The linkage in the synchronized parallelogram may be accomplished by gears, links, slots or rollers.

A problem associated with U.S. Pat. Nos. 7,178,612, 7,249,639 and 7,455,128 is that they have an excessive number of linkages and rotational members as main load bearing elements. These linkage and rotational members tend to wear out and fail since they take a major cantilever load during the movement. Since the synchronized linkage is a main load path of the structure of the device, the synchronized link can easily wear and break. In view of the substantial structure of the other components, the synchronized link is relatively small and fragile. These patents describe an apparatus that also requires a column and guide to absorb the entire cantilever load and overturn moment from the drilling apparatus. The structure of the apparatus described in these patents is also costly to fabricate and difficult to service. Generally, each of the components of the prior art have too many moving elements, is difficult to control, and is prone to deterioration and breakage. Additionally, since the vertical column is located on the drilling floor and since the moving components are located in a position where workman is carrying out their tasks, these devices tend to present a safety hazard at the drilling rig. Also, in these patents, the entire extended arms go up and down while carrying the drilling tool. The guide moves up and down along the column directly under the main rig structure in a very tight space. Since this space has many critical electrical and fluid service lines therein, the prior art can often cause serious problems resulting from contacts and collisions. It can also potentially damage the rig structure.

It is an object of the present invention to provide an articulated handling apparatus that effectively allows for the movement of the drilling apparatus from a stowed position to a deployed position.

It is another object of the present invention to provide an articulated handling apparatus which places vertical movement adjacent to the well center or mouse hole in an open area away from the rig structure and service lines.

It is a further object of the present invention to provide an articulated handling apparatus that avoids damage to rig structure and equipment.

It is another object of the present invention to provide an articulated handling apparatus that better distributes cantilever load and overturn moment by only moving the drilling tool.

It is still a further object of the present invention to provide an articulated handling apparatus that is easy to service and to fabricate.

It is still another object of the present invention to provide an articulated handling apparatus which minimizes wear-and-tear and failure rates by using hydraulic or pneumatic actuators as the main load bearing elements.

It is a further object of the present invention to provide an articulated handling apparatus that minimizes a risk of damage to drilling rig structure.

These and other objects and advantages of the present invention will become apparent from a reading of the attached specification and appended claims.

BRIEF SUMMARY OF THE INVENTION

The present invention is an articulated handling apparatus for handling a drilling tool. This apparatus comprises a base, a first set of arms pivotally connected at one end to the base and extending outwardly therefrom, a joint member pivotally connected to an opposite end of the first set of arms, a second set of arms pivotally connected at one end of to the joint member and extending outwardly therefrom, a carrier assembly pivotally connected to an opposite end of the second set of arms, and at least one actuator connected to at least one of the first and second sets of arms for moving the carrier assembly between a stowed position and a deployed position. The carrier assembly has a means for holding and carrying the drilling tool. A drive means is connected to the carrier assembly for moving the tool along the carrier assembly.

In the present invention, the base is rotatably connected to the drill floor. The base can be manually manipulated or driven with a hydraulic or electric motor. The first set of arms includes a first arm having one end pivotally connected to the base and an opposite end pivotally connected to the joint member, and a second arm having one end pivotally connected to the base and an opposite end pivotally connected to the joint member. The first arm extends in parallel relationship to the second arm. The actuator means has one end pivotally connected to the base and an opposite end pivotally connected to one of the first and second arms in a location between the ends thereof or connected to the joint member directly. The first set of arms can also include a third arm having one end pivotally connected to the base and an opposite end pivotally connected to the joint member, and a fourth arm having one end pivotally connected to the base and an opposite end pivotally connected to the joint member. The first arm and the second arm extend in a common vertical plane. The third arm and the fourth arm extend in a common vertical plane in preferably spaced parallel relationship respectively to the first arm and to the second arm.

In the present invention, the second set of arms includes a first arm having one end pivotally connected to the joint member and an opposite end pivotally connected to the carrier assembly, and a second arm having one end pivotally connected to the joint member and an opposite end pivotally connected to the carrier assembly. The first arm extends in preferably parallel relationship to the second arm. The actuator has one end pivotally connected to the joint member and an opposite end pivotally connected to one of the first and second arms in a location between the ends thereof or connected to the carrier assembly directly. The second set of arms can also include a third arm having one end pivotally connected to the joint member and an opposite end pivotally connected to the carrier assembly, and a fourth arm having one end pivotally connected to the joint member and an opposite end pivotally connected to the railing assembly. The first arm and the second arm extend in a common vertical plane. The third arm and the fourth arm extend in a common vertical plane in preferably spaced parallel relationship respectively to the first arm and to the second arm.

In the present invention, the actuator includes a first actuator having one end connected to the base and an opposite end connected to at least one of the first set of arms, (or connected to the joint member directly) and a second actuator having one end connected to the joint member and an opposite end connected to at least one of the second set of arms (or connected to the carrier assembly directly). As used herein, multiple actuators can be used as the first actuator and the second actuator. A fluid delivery means is connected to the first and second actuators for passing fluid to the actuators such that the actuators respectively move the first set of arms and the second set of arms at a substantially equal angular velocity in opposite directions.

In an alternative embodiment of the present invention, the first set of arms has an upper arm and a lower arm and the second set of arms has an upper arm and a lower arm. The movement of the two sets of arms can be coordinated by a pair of meshed gears or a linkage having one end pivotally connected to the lower arm of the first set of arms and an opposite end pivotally connected to the lower arm of the second set of arms. A pair of meshed gears or a linkage can also be connected to the upper arm of the first set of arms and an opposite end connected to the upper arm of the second set of arms. At least one pair of gears or at least one linkage can be used.

The carrier assembly preferably has at least one vertical rail and has a bracket extending outwardly therefrom. The opposite end of the second set of arms is pivotally connected to the bracket. The carrier has means thereon for receiving a drilling tool thereon. The drive means serves to move the drilling tool vertically along the rail. The drive means can be a hydraulic or pneumatic cylinder, a rotary actuator, a rack-and-pinion, a pulley-and-spool, and similar mechanisms. In the preferred embodiment, the drive means is attached to the carrier assembly and to the drilling tool. Alternatively, the drive means can be only attached to the drilling tool and push directly against the drill floor so as to raise and lower the drilling tool. Even though the use of rail having a channel-type recess for receiving the rollers as a guide means is preferred in this invention to provide stability of vertical movement of the drilling tool, the same stability can also be alternatively achieved by attaching the drive means to the drilling tool such that the attaching point or points corresponds to or aligns with the center of gravity of the drilling tool without using the rail.

DETAILED DESCRIPTION OF THE INVENTION

Figure 1:
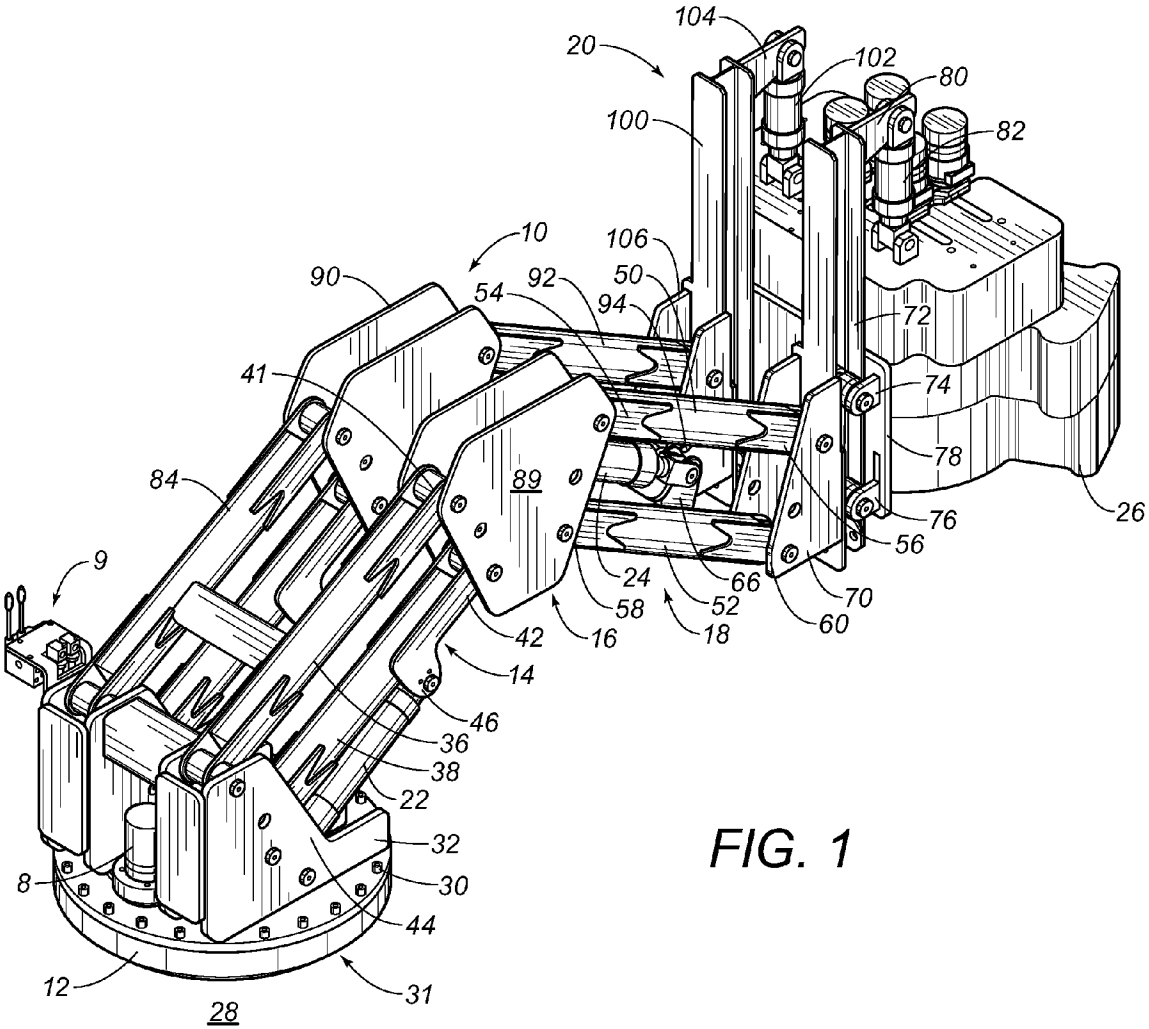
FIG. 1 is a perspective view of the articulated handling apparatus of the present invention.

Referring to FIG. 1, there is shown the articulated handling apparatus 10 in accordance with the preferred embodiment of the present invention. The articulated handling apparatus 10 includes a base 12, a first set of arms 14, a joint member 16, a second set of arms 18, a carrier assembly 20, and a pair of actuators 22 and 24. In FIG. 1, it can be seen that the articulated handling apparatus 10 is in its deployed position. A drilling tool 26 is received by the carrier assembly 20 so as to be positioned in a desired location over well center or over a mouse hole. The drilling tool 26 can be one of the wide variety of components, such as a power tong, a roughneck, a drill string, a top drive, a casing tong, mud bucket, stabbing tool and any other applicable apparatus. The articulated handling apparatus 10 of the present invention is intended to move the drilling tool 26 from a stowed position to a deployed position.

In FIG. 1, it can be seen that the base 12 is suitable for placement onto the floor 28 of a drilling rig. In particular, the base 12 can be affixed by various bolts 30 in a desired position onto the drill floor 28. The base 12 is rotatably mounted to the drilling floor so as to rotate only in a horizontal plane. The base can have a hydraulic or electric motor 80 connected thereto so as to allow the base to he suitably rotated relative to the drilling floor. Alternatively, the base 12 can be suitably mounted by turntable bearing connections so as to allow one to manually manipulate and adjust the angular orientation of the apparatus 10 in relation to the well center. Suitable flanged connections, such as illustrated in FIG. 1, can be used as to effectively secure the base 12 in a desired position. The base 12 includes a flanged portion 32 that extends upwardly in a generally L-shaped framework 34. The connection between the base 12 and the drill floor should be suitably strong enough to support the cantilever effects caused by he movement of the drilling tool 26 from its stowed position to its deployed position.

The first set of arms 14 includes an upper arm 36 and a lower arm 38 extending in generally parallel relationship to each other. The upper arm 36 has one end pivotally connected to an upper portion of the L-shaped framework 34 of base 12. The opposite end 41 of the upper arm 36 is pivotally connected to the joint member 16. One end of the lower arm 38 is pivotally connected to the base 12. An opposite end of the lower arm 38 is pivotally connected to the joint member 16. The actuator 22 is also pivotally connected to a lower portion of the L-shaped framework 34 of base 12 and extends outwardly therefrom so as to connect to a gusset 46 on the lower arm 38 in a location between the ends 42 and 44 thereof. As such, when the actuator 22 is operated, the introduction of fluid pressure into the actuator 22 will tend to move the arms 36 and 38 upwardly.

The second set of arms 18 includes an upper arm 50 and a lower arm 52. The upper arm 50 has one end 54 pivotally connected to joint member 16 and opposite end 56 pivotally connected to the carrier assembly 20. The lower arm 52 has one end 58 pivotally connected to the joint member 16 and an opposite end 60 pivotally connected to the carrier assembly 20. The actuator 24 has an end pivotally connected to the joint member 16 and an opposite end pivotally connected to a gusset 66 extending from the lower arm 52. As can be seen, since actuators 22 and 24 are used in the preferred embodiment of the present invention, there is no linkage required by the upper arms 36 and 50 and the lower arms 38 and 52. As such, the wear associated with such linkages is effectively avoided.

The carrier assembly 20 includes a bracket 70 at a lower end thereof. The carrier assembly 20 includes vertical rail 72 extending upwardly therefrom. Rollers 74 and 76 are received by the vertical rail 72 and can ride along the vertical rail 72 upwardly and/or downwardly. A suitable bracket 78 is connected the drilling tool 26 so as to allow the drilling tool to be moved upwardly and downwardly by the relationship between the rollers 74 and 76 and the vertical rail 72. An arm 80 is affixed to the vertical rail 72 and extends outwardly therefrom. A drive means 82 is connected to the arm 80 and to the drilling tool 26 so as to cause this upward and/or downward movement. In this manner, the present invention is able to achieve vertical movement of the drilling tool 26 relative to the carrier assembly 20. The operation of the present invention allows the drilling apparatus 26 to move not only inwardly and outwardly but also upwardly or downwardly. The rotational mounting of the base 12 on the floor 28 allows the present invention to pivot so as to angularly position the drilling tool 26 in a horizontal plane. As such, the present invention is adaptable for accurate positioning of the drilling tool in a desired location. As used herein, the "drive means" 82 particularly illustrates a hydraulic or pneumatic actuator. However, this term"drive means" refer to a wide variety of other mechanisms, such as a rack-and-pinion assembly, a sprocket-and-gear arrangement, a motor drive, or a rotary actuator. The drive means can be alternatively attached to the top, the bottom or the sides of the drilling tool. As seen here, the advantage of using the carrier assembly in the present invention provides a common supporting means to easily and quickly remove the existing drilling tool and replace it with another tool for a different operation.

In FIG. 1, it can be seen that there is motor 8 that is mounted on the base 12 and connected to the L-framework 34 so as to allow for the rotational movement, if desired, of the articulated handling apparatus 10. Various other motor configurations can be employed in order to achieve this effect. A valve assembly 9 is provided on the base 12 so as to allow hydraulic or pneumatic fluid to be introduced into the actuators 22 and 24.

The first set of arms 14 includes arms 84 and 86. Arms 36 and 38 extend in parallel relationship to each other. Arms 84 and 86 extend parallel relationship to each other. Arms 36 and 38 extend in a generally common vertical plane. Similarly, arms 84 and 86 also extend in a common vertical plane in parallel spaced relationship to the vertical plane in which arms 36 and 38 extend. The joint member 16 has a first joint member 89 pivotally connected to the arms 36 and 38. Another joint member 90 is pivotally connected to the ends of arms 84 and 86. The first joint member 89 and the second joint member 90 are positioned in parallel spaced relationship to each other. The second set of arms 18 also includes arms 92 and 94 (not shown in FIG. 1). Arms 92 and 94 extend in generally parallel relationship to each other. The arms 50 and 52 are in a common vertical plane. Arms 92 and 94 are also are in this common vertical plane. These common vertical planes are in parallel spaced relationship to each other. Arms 92 and 94 are pivotally connected to the second joint member 90. Arms 50 and 52 are pivotally connected to the first joint member 89.

The carrier assembly 20 is illustrated as having vertical rail 72. The carrier assembly 20 also has another vertical rail 100 The carrier assembly 20 includes rollers that are received within the channels of the vertical rails 72 and 100. The second vertical rail 100 also has an actuator 102 that is connected to arm 104 extending outwardly from an upper end thereof. Actuators 82 and 102 form the "driving means" for the movement of the drilling tool 26 upwardly and downwardly. When a hydraulic fluid is introduced into the actuators 82 and 102, the piston assembly associated with the actuators 82 and 102 will correspondingly move the drilling tool 26 downwardly. As hydraulic fluid is released from the actuators 82 and 102, the piston associated with the cylinder of the actuator will move upwardly so as to correspondingly move the drilling tool 26. The vertical rail 100 also includes a bracket 106 that is pivotally connected to the opposite ends of arms 92 and 94. Although the preferred embodiment uses rails, a variety of other mechanisms can be used to support the drilling tool 26.

Figure 2:
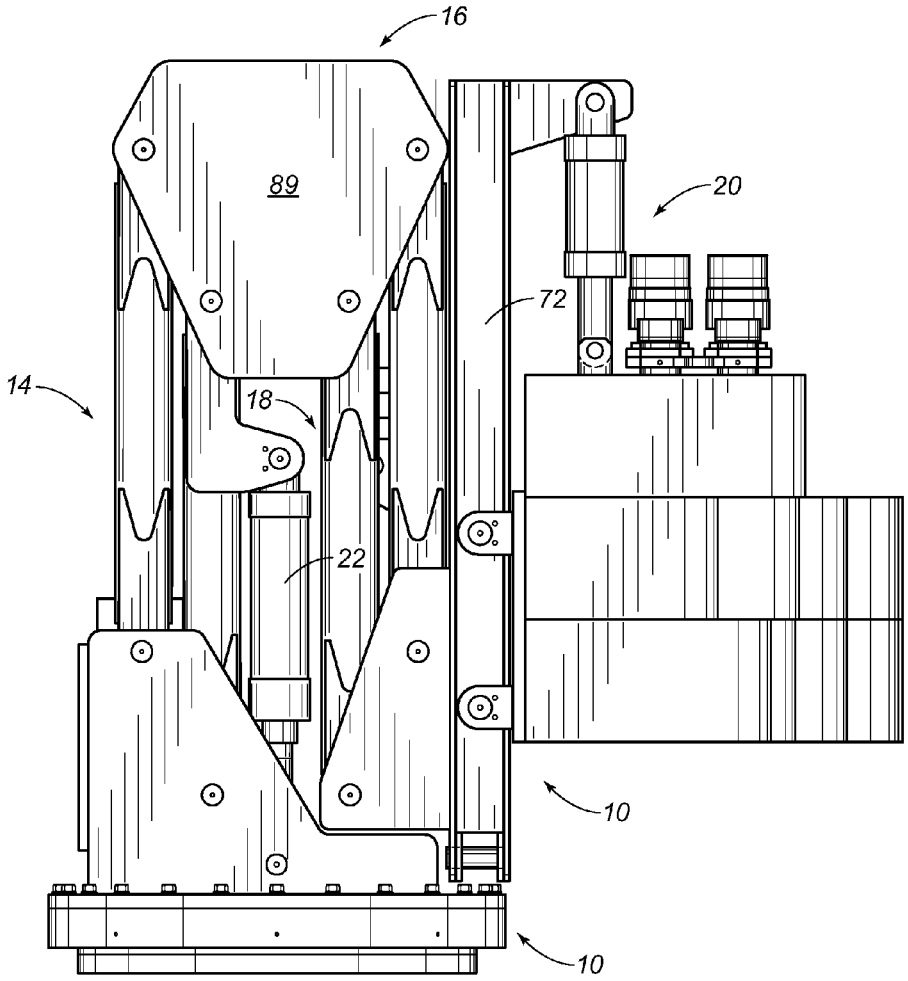
FIG. 2 is a side elevational view of the articulated handling apparatus of the present invention showing, in particular, the apparatus in a stowed position.

FIG. 2 illustrates the articulated handling apparatus 10 of the present invention in its stowed position. Virtually all of the components are in a location above the base 12. The first set of arms 14 extend upwardly vertically from the base 12. The joint member 16 is positioned directly above the base 12. The second set of arms 18 also extend vertically above the base 12. The actuator 22 is illustrated in a generally vertical orientation and is positioned between the first set of arms 14 and the second set of arms 18. The carrier assembly 20 is illustrated as having the vertical rail 72 extending slightly outwardly of the base 12. The carrier assembly 20 remains in a generally vertical orientation and is folded so as to be in proximity to the second set of arms 18. As can be seen, the articulated handling apparatus 10 of the present invention is movable to a stowed position in which each of the components is neatly positioned against each other in a compact configuration above the drill floor. As can be seen, the articulated handling apparatus 10 of the present invention has a relatively small profile and footprint on the generally tight space of the drill floor.

Figure 3:
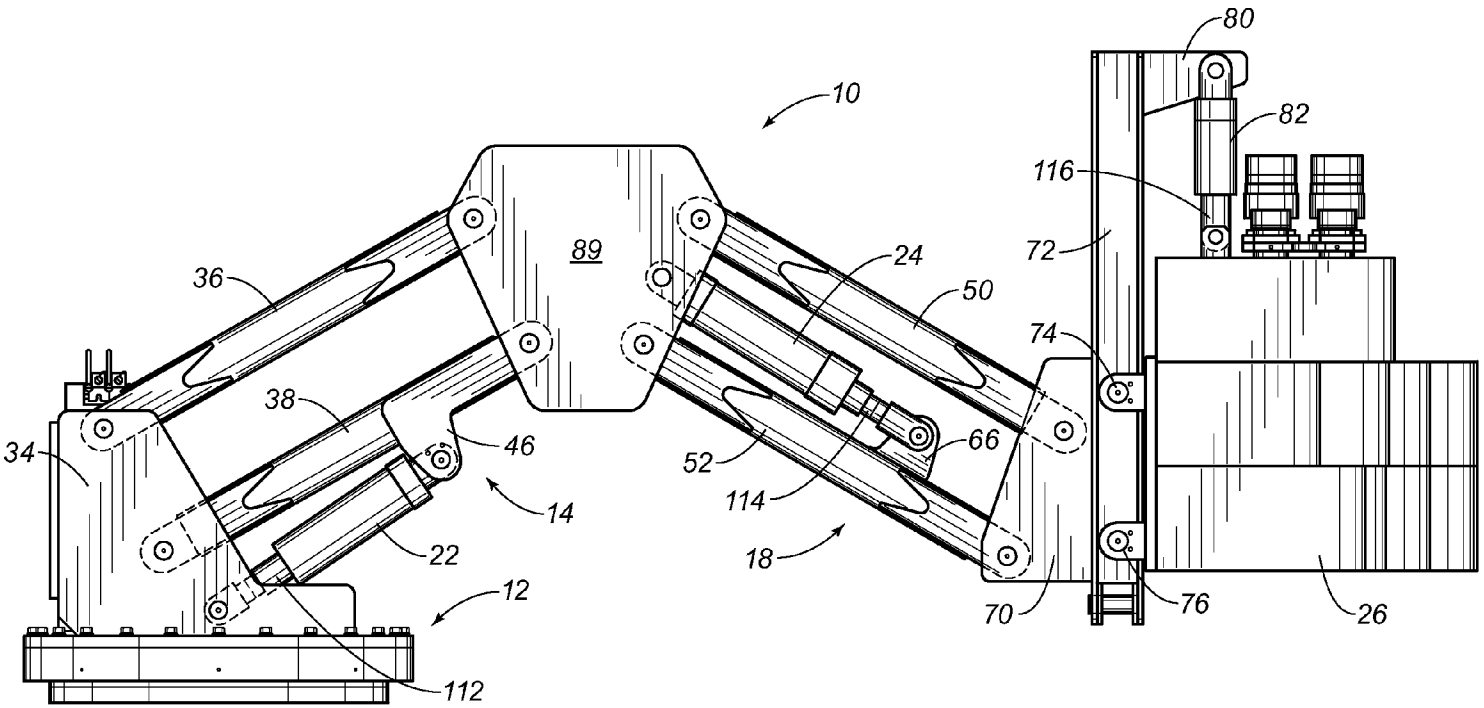
FIG. 3 is a side elevational view of a preferred embodiment of the articulated handling apparatus of the present invention.

FIG. 3 shows the articulated handling apparatus 10 of the present invention as in its deployed position. As can be seen, the base 12 has the first set of arm 14 extending outwardly therefrom. The actuator 22 receives fluid pressure therein so as to urge the piston 112 outwardly therefrom. This correspondingly exerts a force onto the gusset 46 so as to urge the arms outwardly from the stowed position (as illustrated in FIG. 2). It can be seen that each of the first set of arms 14 is pivotally connected at different location to the L-shaped framework 34 of the base 12. The opposite end of the arms 36 and 38 are pivotally connected to the first joint member 89. Similarly, the arms 50 and 52 are pivotally connected to an opposite side of the first joint member 89. The actuator 24 is suitably actuated so as to urge the piston 114 outwardly therefrom so as to act on the gusset 66. Once again, this urges the second set of arms 18 outwardly from the stowed position. The opposite ends of the arms 50 and 52 are each pivotally connected to the bracket 70. At least one actuator 22 or more is used. At least one actuator 24 or more is used.

The rail 72 is affixed to the bracket 70 and extends upwardly therefrom. Rollers 74 and 76 are received within the channel of the rail 72 and are suitably connected to the drilling tool 26. The actuator 82 is pivotally connected to the arm 80 and actuated so as to urge the piston 116 downwardly and/or upwardly so as to cause the drilling tool 26 to move vertically downwardly and/or upwardly.

The articulated handling apparatus 10, as illustrated in FIGS. 1-3 herein, achieves significant advantages over the prior art. As can be seen, the articulated handling apparatus 10 of the present invention has a minimal number of linkages and rotational members. As such, the present invention tends to minimize the wear and tear of such linkages and rotational members. The present invention, as shown in FIGS. 1-3, does not use a synchronized link between the rotational members. As such, the present invention avoids a main load path of such synchronized linkage and, as a result, avoids any possible wear and breakage of such linkage. In the prior art, the synchronized link is relatively small and fragile. In the present invention, the movement of the drilling tool, and the cantilever effects associated with such movements, are absorbed by the entire structure of the apparatus. The present invention allows the drilling tool to be easily moved from a stowed position to a deployed position. The stowed position affords a relatively small footprint and profile within the drilling rig structure. The present invention places the vertical movement of the drilling tool adjacent to the well center or mouse hole. Additionally, this vertical movement is located an area away from the rig structure and the service lines associated with such rig structure. The cantilever load and overturn moment are better distributed throughout the articulated handling apparatus 10. The articulated handling apparatus 10 is easy to service and to fabricate. The hydraulic or pneumatic actuators as used in the present invention serve to be the main load bearing elements. As such, wear-and-tear and failure rates are minimized. Although only two sets of arms and one set of joint members are configured in the preferred embodiment, a third or fourth set of arms, if necessary, can also be added to the end of the second set of arms with additional joint members between the second and third sets of arms to provide an extra longer reach to the well center location. The joint member and the set of arms can be inverted upside down.

Figure 4:
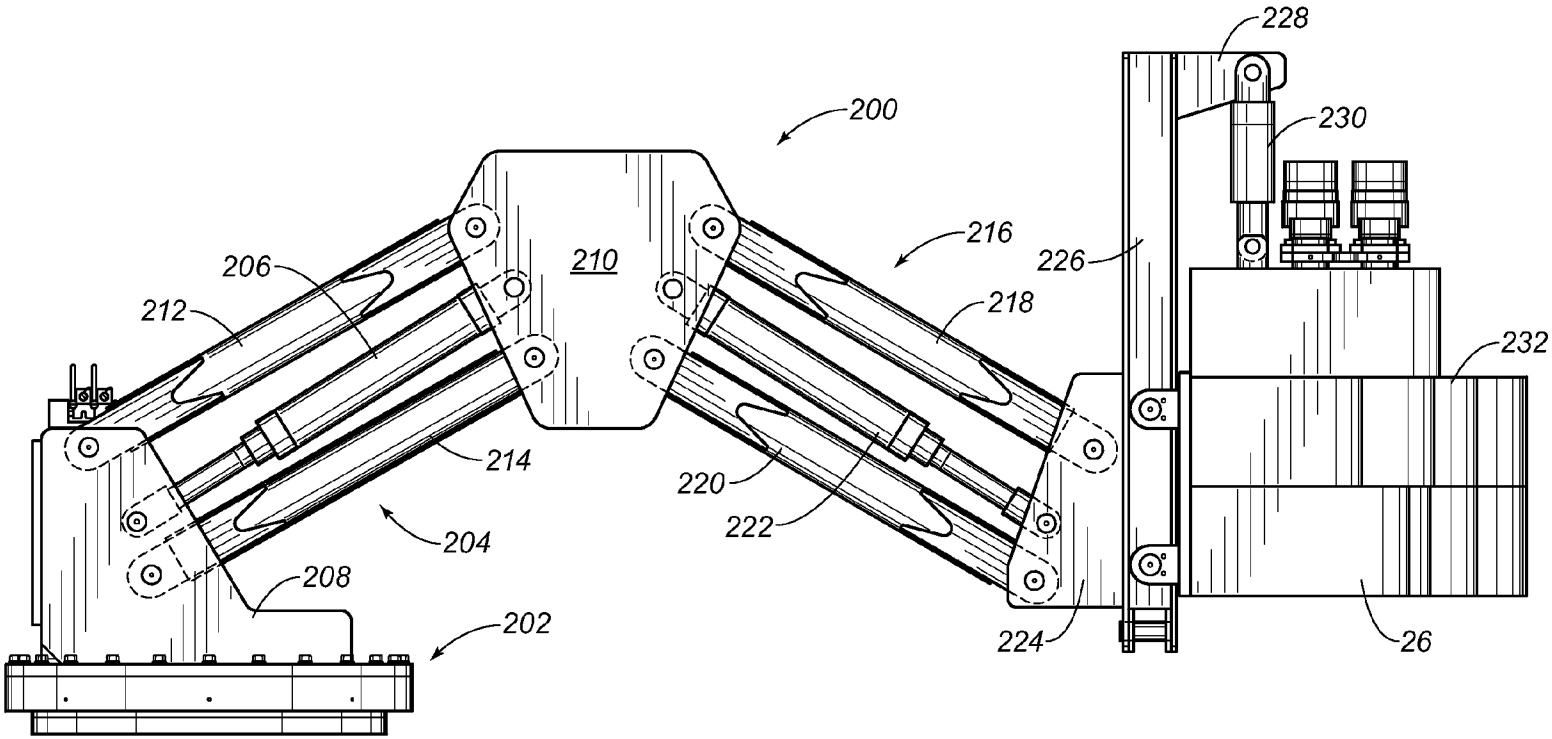
FIG. 4 shows a side elevational view of a first alternative embodiment of the articulated handling apparatus of the present invention showing, in particular, how the actuators are connected between the base, the joint member and the carrier assembly.

FIG. 4 shows an alternative embodiment 200 of the articulated handling apparatus of the present invention. In FIG. 4, it can be seen that the base 202 has a first set of arms 204 extending outwardly therefrom. An actuator 206 has one end pivotally connected to the L-shaped framework 208 of the base 12 and an opposite end pivotally connected to the joint member 210. The actuator 206 is positioned so as to extend between the upper arm 212 and the lower arm 214. At least one actuator 206 or more is used. At least one actuator 222 or more is used.

The second set of arms 216 are also pivotally connected to an opposite side of the joint member 210. The second set of arms 216 includes an upper arm 218 and lower arm 220. The actuator 222 has one end pivotally connected to the joint member 210 and an opposite end pivotally connected to the bracket 224. The opposite ends of the upper arm 218 and lower arm 220 are also pivotally connected to the bracket 224. The bracket 224 supports the rail 226 thereon. An arm 228 extends outwardly from an upper end of the vertical rail 226. An actuator 230 is connected to the arm 228 and also to the drilling tool 232 so as to allow the drilling tool 232 to move upwardly and downwardly along the rail 226 and with respect to the drill floor. As used herein, the actuators 206 and 222 can each include multiple actuators.

Figure 5:
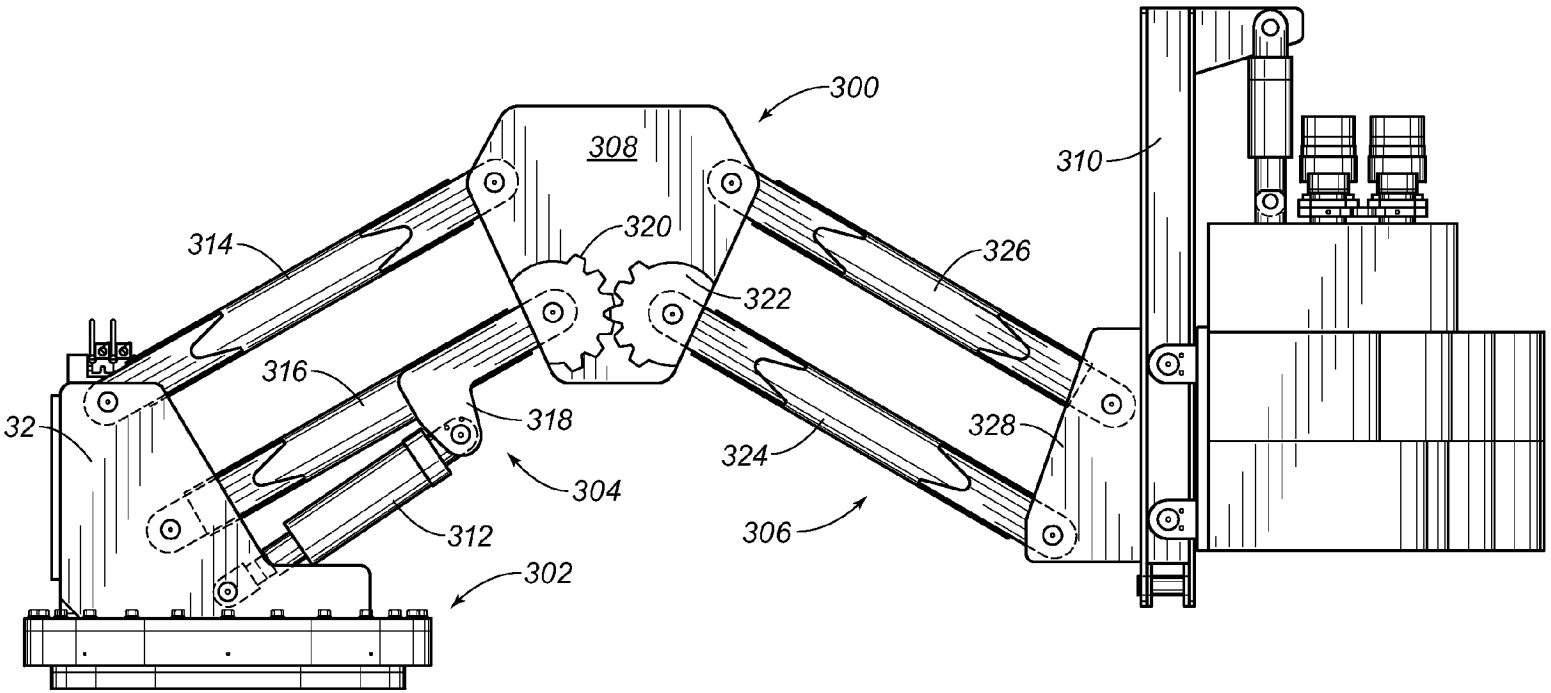
FIG. 5 is a side elevational view of another alternative embodiment of the articulated handling apparatus of the present invention showing, in particular, how the second set of arms are driven by a pair of gears.

FIG. 5 shows another alternative embodiment of the articulated handling apparatus 300 of the present invention. The articulated handling apparatus 300 includes the base 302, the first set of arms 304, the second set of arms 306, the joint member 308 and the carrier assembly 310. Actuator 312 acts on the first set of arms 304. The first set of arms 304 includes an upper arm 314 and lower arm 316. The upper arm 314 and the lower arm 316 are pivotally connected to the base 302. Similarly, the actuator 312 is also pivotally connected to the base 302. The opposite end of the actuator 312 is pivotally connected to a gusset 318 extending downwardly from the lower arm 316. The upper arm 314 is pivotally connected to one side of the joint member 318. The opposite end of the lower arm 316 is also pivotally connected to the side of the joint member 308. Importantly, there is a gear 320 that is connected to the end of the lower arm 316 and positioned within the plates of the joint member 318. The gear 320 meshes with another gear 322 that is connected to the end of the lower arm 324 of the second set of arms 306. The upper arm 326 of the second set of arms 306 has one end pivotally connected to the joint member 308 and an opposite end pivotally connected to the bracket 328. The opposite end of the lower arm 324 is also pivotally connected to the bracket 328. The carrier assembly 310 has a configuration similar to that described hereinbefore.

In FIG. 5, it can be seen that as the actuator 312 serves to move the first set of arms 304 between the stowed toward the deployed position, the meshing gears 320 and 322 will serve to cause the second set of arms 306 to also move to the outwardly deployed position. As such, the present invention utilizes gears 320 and 322 as a suitable linkage for causing the movement of the articulated handling apparatus 300 between the stowed position and the deployed position. A pair of gears can also be connected to any one arm of the first set of arms and an opposite end connected to any other arm of the second set of arms. At least one pair of gears is used.

Figure 6:
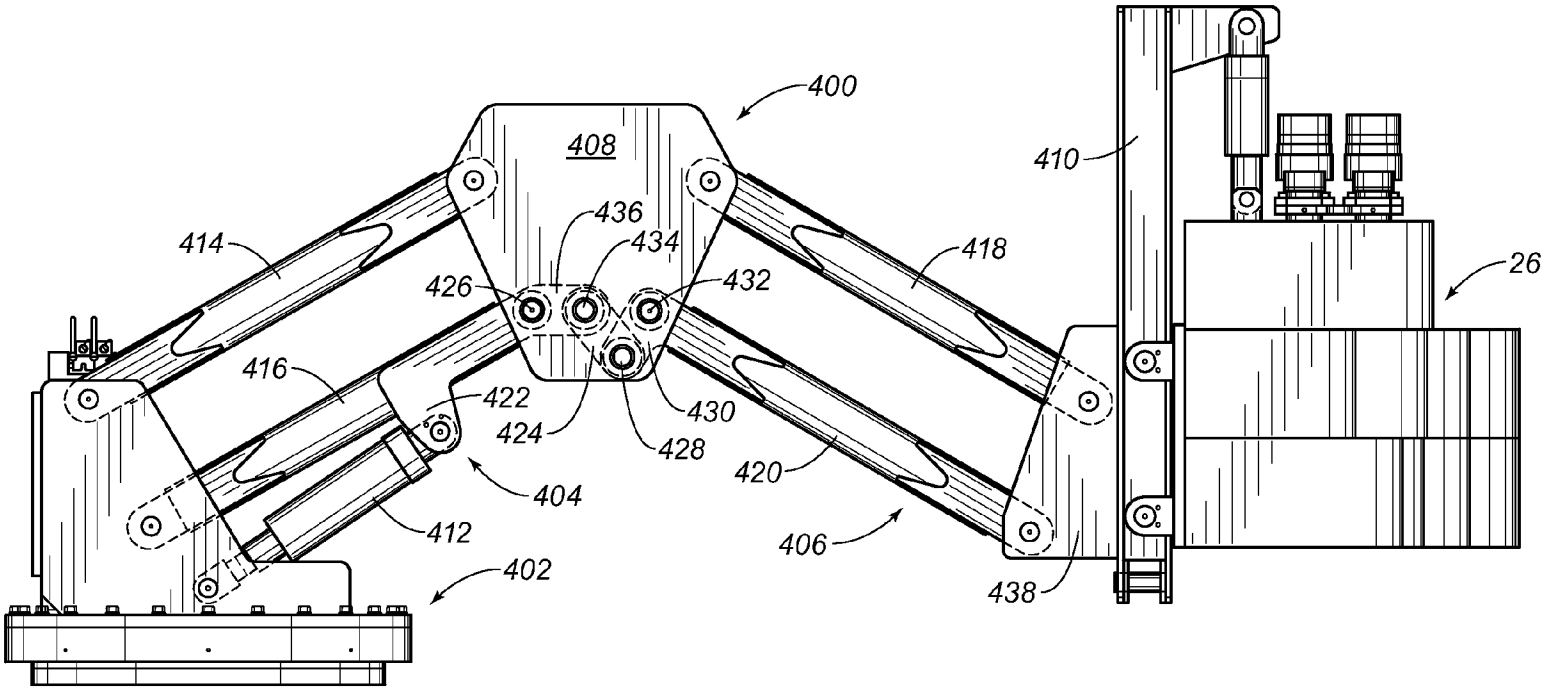
FIG. 6 is a side elevation view of another alternative embodiment of the articulated handling apparatus of the present invention in which the second set of arms are driven by a linkage.

FIG. 6 shows another alternative embodiment of the articulated handling apparatus 400 of the present invention. The articulated handling apparatus 400, as illustrated in FIG. 6, includes the base 402, the first set of arms 404, the second set of arms 406, the joint member 408, and the carrier assembly 410 in a similar configuration to that illustrated in FIGS. 1-3. The actuator 412 acts on the first set of arms 404. The first set of arms 404 includes an upper arm 414 and a lower arm 416. The second set of arms 406 includes an upper arm 418 and a lower arm 420. The actuator 412 is pivotally connected to the base 402 and acts on a gusset 422 extending downwardly from the lower arm 416.

In FIG. 6, it can be seen that there is a linkage 424 that serves to connect the elbow-shaped lower arm 416 to the elbow-shaped lower arm 420. The linkage is generally straight and has a hole in each end. The lower arms 416 and 420 have, respectively, generally elbow-shaped end 436 and 430 pivotally connecting to the joint member 408. The linkage 424 is pivotally connected to the lower arm 416 at the one end of pivot point 434, and pivotally connected to the lower arm 420 at the other end of pivot point 428. Alternatively the linkage 424 can be pivotally connected to any one arm of the first set of arms and connected to one arm of the second set of arms. At least one linkage is used.

The use of the linkage 424, in this form of the invention, provides an alternative mechanical drive means to coordinate the angular movement of the first set and second set of arms. The linkage 424 allows for the movement of the articulated handling apparatus 400 between the stowed position and the deployed position.

Figure 7:
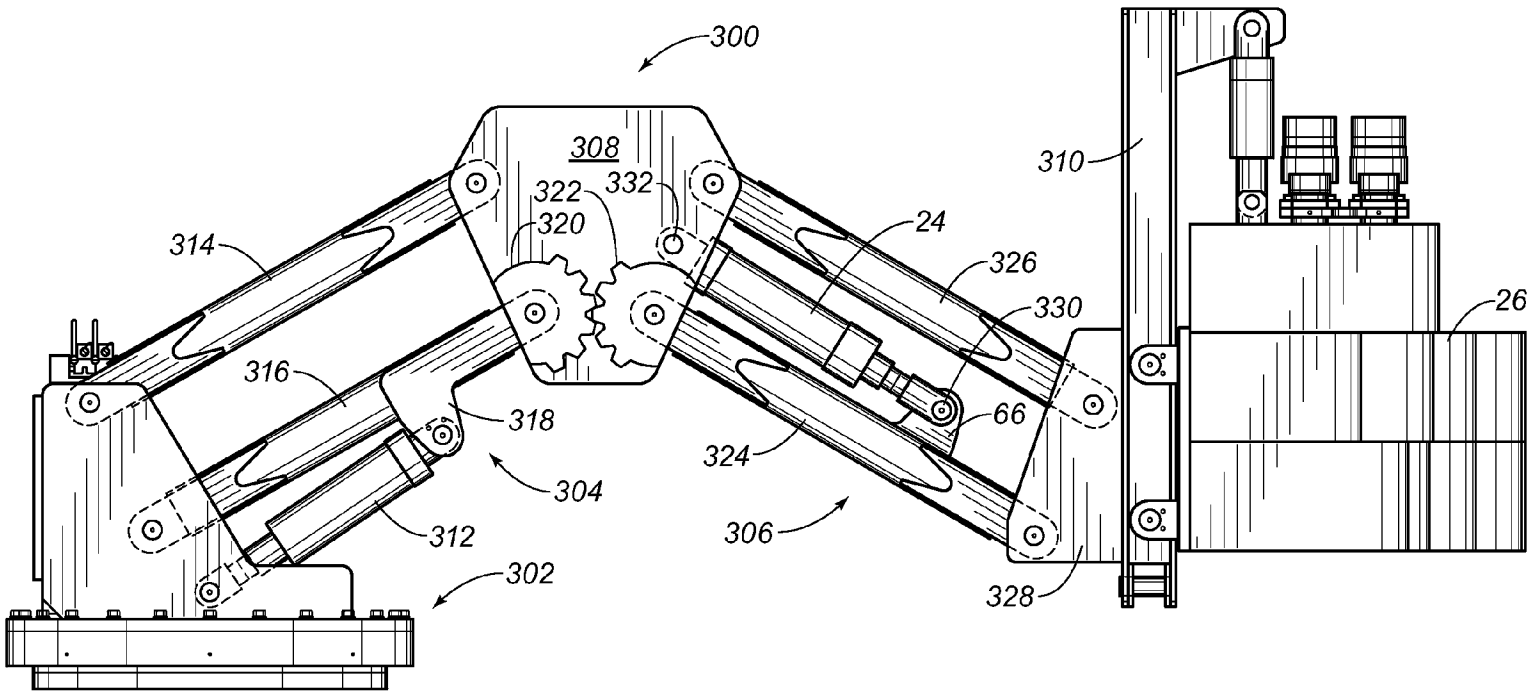
FIG. 7 is a side elevational view of the alternative embodiment of the articulated handling apparatus of the present invention in which a combination of a mechanical drive means and an actuator means are used.

FIG. 7 shows an alternative embodiment of the combination of using the mechanical drive means with the actuator means to deploy the apparatus from the stowed position to the deployed position. The configuration in this embodiment is similar to that described in FIG. 5 hereinbefore with the addition of an actuator means 24 having one end 332 pivotally connected to the joint member 308, and the other end 330 pivotally connected to the gusset 66 attached to the lower arm.

The actuator means 24 is used as a main load-bearing element while the pair of meshed gears 320 and 322 coordinates the angular movement of the first set of arms 304 and the second set of arms 306. The combination of using the mechanical drive means, such as the pair of gears 320 and 322, and the actuator means 24 provides layers of redundancy as a failure-proof system for proper operation of the articulated handling apparatus which is particularly useful in drilling operations. The mechanical drive means can compensate for any possible disparities in the operation of the actuator 24 so as to allow the movement of the articulated handling apparatus 300 between the stowed position and the deployed position more precisely. The mechanical drive means can be a linkage of the form described in FIG. 6.

Figure 8:
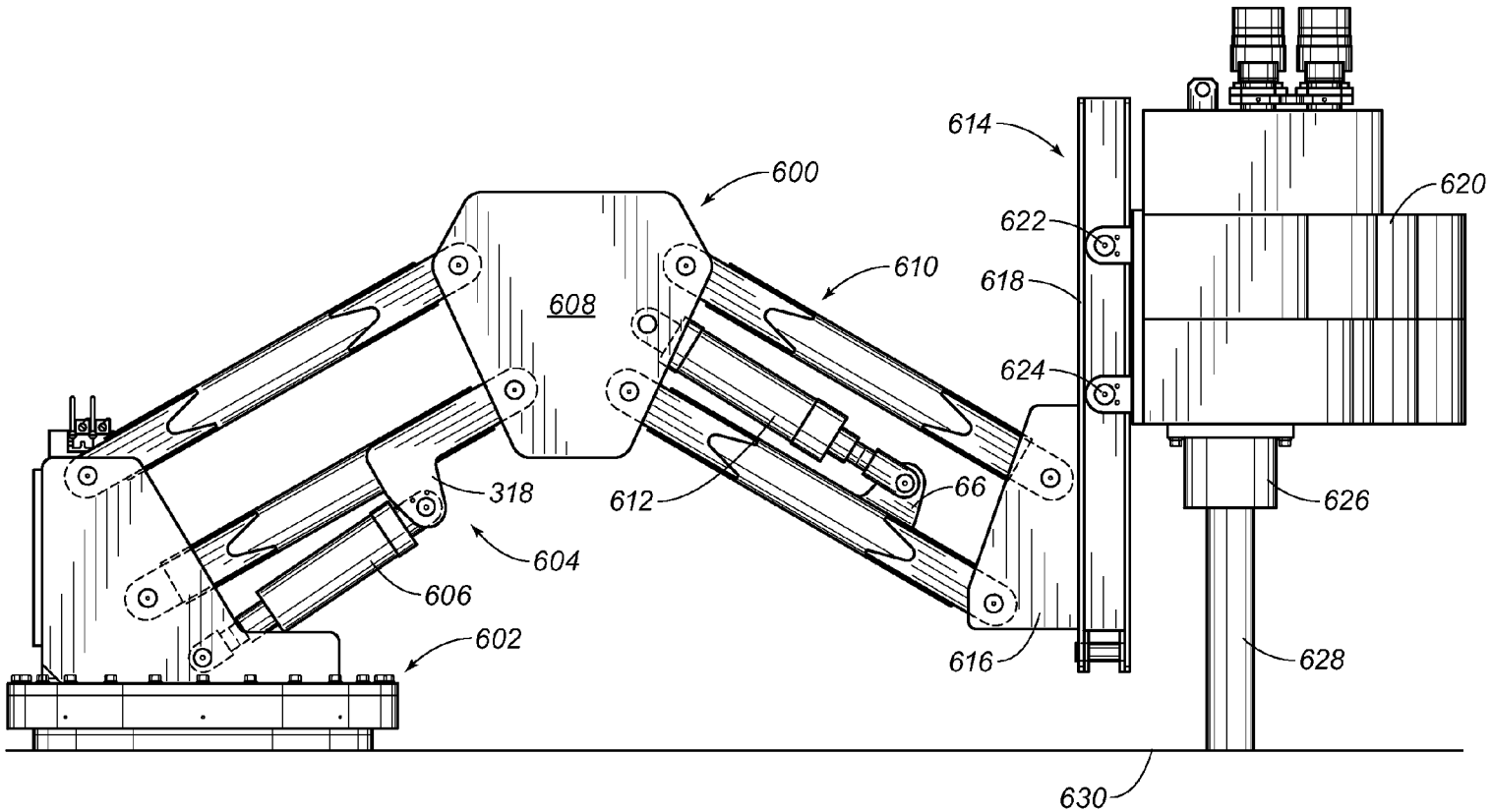
FIG. 8 is a side elevational view of still a further alternative embodiment of the articulated handling apparatus of the present invention in which the drilling tool moves upwardly and downwardly by an actuator pushing directly against the drill floor.

FIG. 8 shows another alternative embodiment of the articulated handling apparatus 600 of the present invention. As with the previous embodiment, the articulated handling apparatus 600 includes a base 602, a first set of arms 604, a first actuator 606, a joint member 608, a second set of arms 610 and a second actuator 612. These components are arranged in a manner similar to that described hereinbefore in association with FIGS. 1-3. Importantly, the carrier assembly 614 is different than that of the previous embodiment.

In FIG. 8, it can be seen that the carrier assembly 614 includes a bracket 616 having a vertical rail 618 extending vertically upwardly therefrom. Importantly, the drilling tool 620 is connected to rollers 622 and 624 received within the channel of the vertical rail 618. There is an actuator 626 connected to the drilling tool 620. The actuator 626 has a piston 628 that can be extended outwardly through the use of hydraulic or pneumatic pressure so as to urge against the drill floor 630. As such, the drilling tool 620 can move upwardly and downwardly along the rail 618 relative to the forces urged upon the drilling tool 620 by the actuator 626. In this embodiment, the actuator 626 is carried by the drilling tool 620 and not by the carrier assembly 614. As seen here, the entire cantilever weight of the drilling tool is relieved from the articulated apparatus itself, and instead the weight is supported by the actuator 626 thus leading to improving overall stability of the apparatus during operation. This is another advantage of using the carrier assembly because the carrier assembly allows the drilling tool to move upwardly and/or downwardly along the carrier.

Figure 9:
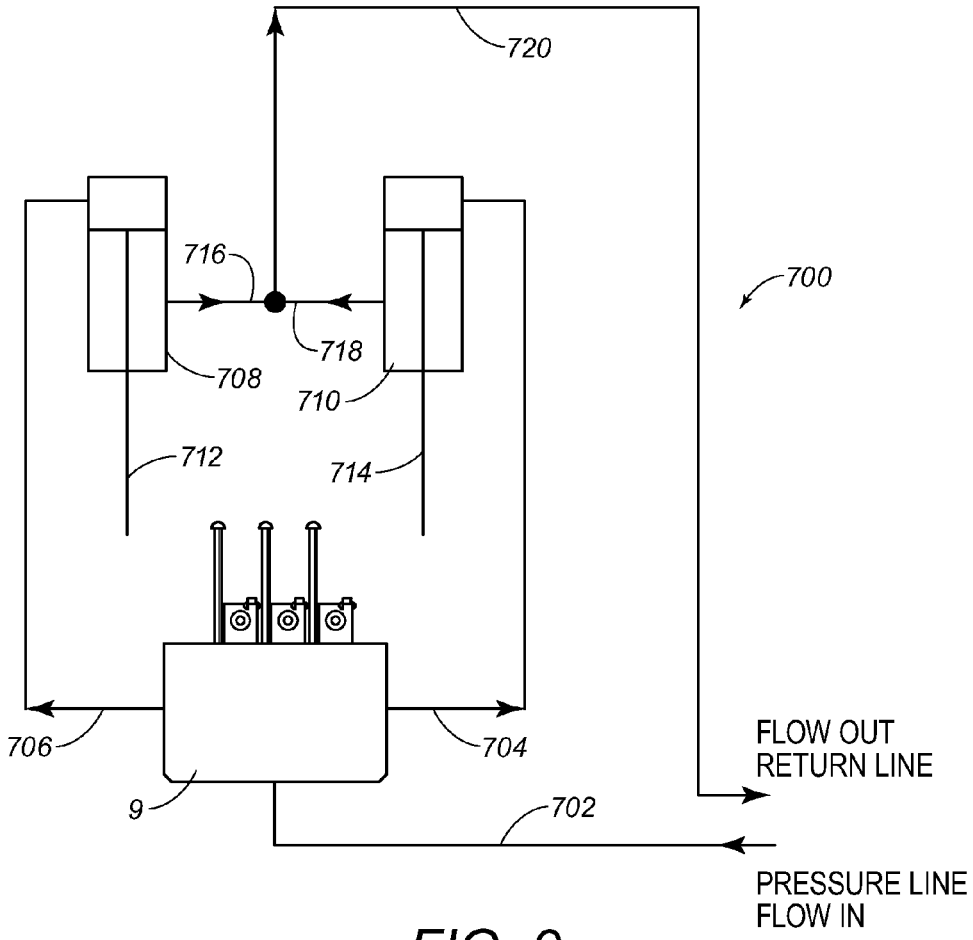
FIG. 9 is fluid diagram showing the hydraulic system suitable for driving the actuators in a desired speed by controlling a flow outlets in a desired ratio from the flow inlet.

FIG. 9 illustrates a hydraulic schematic 700 as used for moving the first and second actuators in an equal pattern. Importantly, this system 700 is connected to the first actuator and the second actuator so as to pass fluid to these actuators such that the actuators move the first set of arms and the second set of arms at a substantially equal velocity in opposite directions. Initially, it can be seen that the valve 9 is connected to a pressure line 702. The valve 9 will cause the fluid flow to pass outwardly along line 704 and 706 to the respective first actuator 708 and the second actuator 710. As such, the respective pistons 712 and 714 of these actuators 708 and 710 can move outwardly therefrom at generally equal or any desired rates. Flow on the other side of the piston within the actuators 708 and 710 can flow outwardly therefrom through lines 716 and 718 along line 720. As such, the valve 9 acts as a flow divider to distribute the inlet flow into a pair of outlets in a desired ratio such that the actuators 708 and 710 move at a desired speed. The schematic of FIG. 9 can also be used for multiple actuators. As such, actuator 708 can be multiple actuators and actuator 710 can be multiple actuators.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An articulated apparatus for handling a drilling tool on a drill floor comprising:

a base suitable for rotatable connection to the drill floor;

a first set of arms pivotally connected at one end to said base and extending outwardly therefrom, said one end of said first set of arms being vertically non-translatable with respect to said base;

a joint member pivotally connected to an opposite end of said first set of arms;

a second set of arms pivotally connected at one end to said joint member and extending outwardly therefrom; and a carrier assembly pivotally connected to an opposite end of said second set of arms, said carrier assembly having at least one rail extending vertically at said opposite end of said second set of arms; and a translating means attached to said carrier assembly and to the drilling tool for moving the drilling tool vertically, said translating means comprising:

at least one set of rollers affixed to the drilling tool and cooperative with the rail; and a driving actuator connected or interconnected to the rail and connected to said drilling tool so as to move said drilling tool and the set of rollers vertically along the rail.

2. The apparatus of claim 1, further comprising:

a drive means for moving the drilling tool between a stowed position and a deployed position.

3. The apparatus of claim 2, said drive means comprising:

at least one first actuator having one end pivotally connected to said base and an opposite end pivotally connected to at least one arm of said first set of arms; and at least one second actuator having one end pivotally connected to said joint member and an opposite end pivotally connected to at least one arm of said second set of arms.

4. The apparatus of claim 3, said drive means further comprising:

a fluid delivery means connected to the at least one first actuator and to the at least one second actuator, said fluid delivery means for passing fluid to the first and second actuators such that the first and second actuators rotate said first set of arms and said second set of arms at a substantially equal angular velocity in opposite directions respectively.

5. The apparatus of claim 1, said first set of arms comprising:

a first arm having one end pivotally connected to said base and an opposite end pivotally connected to said joint member; and a second arm having one end pivotally connected to said base and an opposite end pivotally connected to said joint member, said first arm extending in parallel relationship to said second arm.

6. The apparatus of claim 5, said first set of arms further comprising:

a third arm having one end pivotally connected to said base and an opposite end pivotally connected to said joint member; and a fourth arm having one end pivotally connected to said base and an opposite end pivotally connected to said joint member, said first arm and said second arm extending in a first common vertical plane, said third arm and said fourth arm extending in a second common vertical plane in spaced parallel relationship respectively to said first common vertical plane.

7. The apparatus of claim 1, said second set of arms comprising:

a first arm having one end pivotally connected to said joint member and an opposite end pivotally connected to said carrier assembly; and a second arm having one end pivotally connected to said joint member and an opposite end pivotally connected to said carrier assembly, said first arm extending in parallel relationship to said second arm.

8. The apparatus of claim 7, said second set of arms further comprising:

a third arm having one end pivotally connected to said joint member and an opposite end pivotally connected to said carrier assembly; and a fourth arm having one end pivotally connected to said joint member and an opposite end pivotally connected to said carrier assembly, said first arm and said second arm extending in a first common vertical plane, said third arm and said fourth arm extending in a second common vertical plane in spaced parallel relationship respectively to said first common vertical plane.

9. The apparatus of claim 1, said carrier assembly having a bracket extending outwardly therefrom, said opposite end of said second set of arms being pivotally connected to said bracket.

10. An articulated apparatus for use on a drill floor comprising:

a drilling tool;

a base suitable for being rotatably connected to the drill floor;

a first set of arms pivotally connected at one end to said base and extending outwardly therefrom, said one end of said first set of arms being vertically non-translatable with respect to said base;

a joint member pivotally connected to an opposite end of said first set of arms;

second set of arms pivotally connected at one end to said joint member and extending outwardly therefrom;

a carrier assembly pivotally connected to an opposite end of said second set of arms, said carrier assembly having at least one rail extending vertically at said opposite end of said second set of arms;

a translating means attached to said carrier assembly and to the drilling tool for moving said drilling tool vertically, said translating means comprising:

at least one set of rollers affixed to said drilling tool and cooperative with the rail; and a driving actuator connected or interconnected to the rail and connected to said drilling tool so as to move said drilling tool and the set of rollers vertically along the rail; and a drive means for moving said drilling tool between a stowed position and a deployed position.

11. The apparatus of claim 10, said drive means comprising:

at least one first actuator having one end pivotally connected to said base and an opposite end pivotally connected to said first set of arms in a location between ends thereof; and at least one second actuator having one end pivotally connected to said joint member and an opposite end pivotally connected to said second set of arms in a location between ends thereof.

12. The apparatus of claim 11, said drive means further comprising:

a fluid delivery means connected to the first actuator and to the second actuator, said fluid delivery means for passing fluid to the first actuator and the second actuator such that the first and second actuators respectively move said first set of arms and said second set of arms at a substantially equal angular velocity in opposite directions.

13. The apparatus of claim 12, wherein said each first and second actuator is selected from the group consisting of hydraulic actuators, pneumatic cylinders and rotary actuators.

14. The apparatus of claim 10, said drive means comprising:

at least one first actuator having one end pivotally connected to said base and an opposite end pivotally connected to said joint member; and at least one second actuator having one end pivotally connected to said joint member and an opposite end pivotally connected to said carrier assembly.

15. An articulated apparatus for handling a drilling tool on a drill floor comprising:

a base suitable for rotatable connection to the drill floor;

a first set of arms pivotally connected at one end to said base and extending outwardly therefrom, said one end of said first set of arms being vertically non-translatable with respect to said base;

a joint member pivotally connected to an opposite end of said first set of arms;

a second set of arms pivotally connected at one end of to said joint member and extending outwardly therefrom;

a carrier assembly pivotally connected to an opposite end of said second set of arms, said carrier assembly having at least one rail extending vertically at said opposite end of said second set of arms;

a translating means attached to said carrier assembly and to the drilling tool for moving the drilling tool vertically, said translating means comprising:

at least one set of rollers affixed to said drilling tool and cooperative with the rail; and a driving actuator connected or interconnected to the rail and connected to said drilling tool so as to move said drilling tool and the set of rollers vertically along the rail;

an actuator means connected to said first set arms for causing said first set of arms to move inwardly and outwardly; and a mechanical drive means connected to or interconnected to said first set of arms for driving said second set of arms inwardly and outwardly.

16. The apparatus of claim 15, said actuator means comprising:

at least one actuator having one end pivotally connected to said base and an opposite end pivotally connected to said first set of arms in a location between ends thereof.

17. The apparatus of claim 15, said actuator means comprising:

at least one actuator having one end pivotally connected to said base and an opposite end pivotally connected to said joint member.

18. The apparatus of claim 15, said actuator means being a hydraulic or pneumatic cylinder or a rotary actuator.

19. The apparatus of claim 15, said mechanical drive means being a pair of gears.

20. The apparatus of claim 15, said mechanical drive means being a mechanical linkage.

21. An articulated apparatus for use in conjunction with a drill floor comprising:

a drilling tool;

a base suitable for rotatable connection to said drill floor;

a first set of arms pivotally connected at one end of said base and extending outwardly therefrom, said one of end of said first set of arms being vertically non-translatable with respect to said base;

a joint member pivotally connected to an opposite end of said first set arms;

a second set of arms pivotally connected at one end to said joint member and extending outwardly therefrom;

a carrier assembly pivotally connected to an opposite end of said second set of arms, said carrier assembly having at least one rail extending vertically at said opposite end of said second set of arms;

a translating means cooperative with said drilling tool and said carrier assembly for moving said drilling tool vertically upwardly in relation to said drill floor, said translating means comprising:

at least one set of rollers affixed to said drilling tool and cooperative with the rail; and a driving actuator connected or interconnected to the rail and connected to said drilling tool so as to move said carrier assembly and the set of rollers vertically along the rail.

22. The apparatus of claim 21, the driving actuator being a hydraulic or pneumatic cylinder or a rotary actuator.

23. The apparatus of claim 21, said base having a hydraulic or electrical motor connected thereto so as to allow the base to be rotated relative to the drill floor.

* * * * *